US007473151B2

(12) United States Patent
Toyoda et al.

(10) Patent No.: US 7,473,151 B2
(45) Date of Patent: Jan. 6, 2009

(54) METHOD FOR MANUFACTURING A SUBSTRATE FOR A FLAT PANEL DISPLAY INCLUDING FORMING GROOVES IN A SURFACE

(75) Inventors: Osamu Toyoda, Akashi (JP); Motonari Kifune, Miyazaki (JP); Mituji Yamamoto, Akashi (JP); Kazunori Inoue, Akashi (JP)

(73) Assignee: Hitachi, Ltd., Tokyo (JP)

( * ) Notice: Subject to any disclaimer, the term of this patent is extended or adjusted under 35 U.S.C. 154(b) by 726 days.

(21) Appl. No.: 10/438,199

(22) Filed: May 15, 2003

(65) Prior Publication Data

US 2004/0038616 A1 Feb. 26, 2004

(30) Foreign Application Priority Data

Aug. 26, 2002 (JP) ..... 2002-245719

(51) Int. Cl.
*H01J 9/00* (2006.01)

(52) U.S. Cl. ..... 445/24

(58) Field of Classification Search ..... 445/24, 445/25, 50, 51; 313/582–587
See application file for complete search history.

(56) References Cited

U.S. PATENT DOCUMENTS 5,209,688 A * 5/1993 Nishigaki et al. ..... 445/24
5,244,427 A * 9/1993 Umeya ..... 445/24
5,886,463 A * 3/1999 Damen et al. ..... 313/422
5,898,271 A * 4/1999 Mehrotra et al. ..... 313/582
5,990,619 A * 11/1999 Ilcisin et al. ..... 313/584
6,541,922 B2 * 4/2003 Shirozu ..... 315/169.4
6,544,090 B1 * 4/2003 Anderson et al. ..... 445/24
2002/0127942 A1 * 9/2002 Kim et al. ..... 445/24
2003/0205558 A1 * 11/2003 Kuzuwa et al. ..... 216/97

FOREIGN PATENT DOCUMENTS

| | | |
|---|---|---|
| JP | 56-22657 | 3/1981 |
| JP | 59-83950 | 5/1984 |
| JP | 06-016440 | 1/1994 |
| JP | 09-161683 | 6/1997 |
| JP | 11-273557 | 10/1999 |
| JP | 2000-268716 | 9/2000 |
| JP | 2000-277011 | 10/2000 |
| JP | 2000-302474 | 10/2000 |
| JP | 2001-110304 | 4/2001 |
| JP | 2002-056782 | 2/2002 |
| JP | 2002-075177 | 3/2002 |
| JP | 2002-117769 | 4/2002 |
| JP | 2005336018 | * 12/2005 |

* cited by examiner

*Primary Examiner*—Joseph L Williams
(74) *Attorney, Agent, or Firm*—Staas & Halsey LLP

(57) ABSTRACT

A method of manufacturing a substrate for a flat panel display includes forming grooves in a bottom surface of a float glass substrate by a subtractive process to form barrier ribs. The barrier ribs include the protrusions remaining between the respective grooves.

13 Claims, 11 Drawing Sheets

| Condition | Average diameter | Pressure (MPa) | Ry (μm) | Rz (μm) | Ra (μm) |
|---|---|---|---|---|---|
| 1 | #600 (20μmφ) | 0.2 | 30.9 | 30.0 | 1.6 |
| 2 | #600 (20μmφ) | 0.2 | 22.2 | 18.7 | 0.9 |
| | #1200 (10μmφ) | 0.05 | | | |
| 3 | #600 (20μmφ) | 0.2 | 20.2 | 16.0 | 0.8 |
| | #2000 (6μmφ) | 0.1 | | | |
| 4 | #600 (20μmφ) | 0.2 | 16.9 | 13.7 | 0.7 |
| | #1200 (10μmφ) | 0.05 | | | |
| | #2000 (6μmφ) | 0.1 | | | |

Fig. 8

METHOD FOR MANUFACTURING A SUBSTRATE FOR A FLAT PANEL DISPLAY INCLUDING FORMING GROOVES IN A SURFACE

BACKGROUND OF THE INVENTION

1. Field of the Invention

The present invention relates to methods for manufacturing substrates for flat panel displays and relates to methods for forming barrier ribs in flat panel displays. The present invention particularly relates to a method for manufacturing a substrate for flat panel displays such as plasma display panels (PDP), plasma addressing liquid crystal display panels (PALC), and field emission display panels (FED), which include partition walls for partitioning a space between a pair of float glass substrates and relates to a method for forming such barrier ribs in such flat panel displays.

2. Description of the Related Art

An exemplary conventional method for forming a rear substrate for plasma display panels is described below. FIGS. 1A through 10E are an illustration showing steps in a conventional method for forming barrier ribs. As shown in FIG. 1A, in a first step, address electrodes 11 are formed on the top surface (non tin-side surface) of a float glass substrate 10. When the address electrodes 11 are of a thin film technology, the address electrodes 11 are formed according to the following procedure: a layer consisting of a first chromium sub-layer, a copper sub-layer, and a second chromium sub-layer disposed in that order is formed by a sputtering process, and the formed layer is then etched by a photolithographic process so as to form a predetermined pattern. When the address electrodes 11 are of a thick film technology, the address electrodes 11 are formed according to the following procedure: silver powder, a glass binder, a resin, a solvent, and the like are mixed to prepare silver paste, and a pattern is formed by a screen-printing process using the silver paste. In this step, the address electrodes 11 are formed on the top surface (non tin-side surface) of the float glass substrate in order to prevent the following phenomenon: when the address electrodes 11 are formed on the bottom surface (tin-side surface) of the float glass substrate, copper and silver react with tin lying on the bottom surface to form colloid containing copper and silver, and the formed colloid are diffused in the float glass substrate, thereby causing colored portions in the float glass substrate. Dielectric paste is then applied onto the address electrodes 11, and the resulting dielectric paste is dried and then fired to form a dielectric layer 12.

In a second step shown in FIG. 1B, a partition wall paste 13 is applied over the dielectric layer 12 formed in the first step, and the resulting partition wall paste 13 is then dried. The partition wall paste 13 may be applied onto the dielectric layer 12 with a dye coater in one step. Alternatively, the partition wall paste 13 may be provided on the dielectric layer 12 by a screen-printing process to form a plurality of layers.

In a third step shown in FIG. 1C, after the partition wall paste 13 is dried, resist pattern portions 14 are provided on the partition wall paste 13 such that the resist pattern portions 14 cover regions for forming barrier ribs. The resist pattern portions 14 are usually formed according to the following procedure: a dry resist film is joined to the partition wall paste 13, and the resulting dry resist film is then etched by a photolithographic process so as to form a desired pattern.

In a fourth step shown in FIG. 1D, the partition wall paste 13 is sandblasted with a sandblast gun 15 using an abrasive 16 containing fine calcium particles, thereby removing portions of the partition wall paste 13, the portions not being covered with the resist pattern portion 14.

In a fifth step shown in FIG. 1E, the resist pattern portions 14 are removed from the resulting partition wall paste 13, and the partition wall paste 13 is then fired to form barrier ribs 17.

In the float glass substrate 10 having the above components formed according to the above procedure, grooves are disposed between the barrier ribs 17. Fluorescent layers having the corresponding three primary colors are then formed in the corresponding grooves. Another substrate is separately prepared. A plurality of pairs of sustaining electrodes, a transparent dielectric layer covering the sustaining electrodes, and a protective layer comprising MgO and the like and covering the transparent dielectric layer are formed on the substrate. The substrate is joined to the float glass substrate 10 in such a manner that all the components are disposed between the substrates. A sealing material is provided at the periphery of the joined substrates to seal the space therebetween, and gas is evacuated from the space. The space is then filled with a mixture gas containing neon and xenon, thereby obtaining a plasma display panel.

In order to reduce the cost of manufacturing plasma display panels, the inventors have proposed a new method for forming barrier ribs, and the method is disclosed in Japanese Unexamined Patent Application Publication No. 2001-43793.

In the above method, grooves arranged at a predetermined pitch are directly provided in a surface of a rear substrate processed in a step of manufacturing a plasma display panel to form barrier ribs.

FIG. 2 is an illustration showing a method for manufacturing a glass substrate (float glass substrate) by a float process. As shown in FIG. 2, raw materials such as silica sand, soda ash, and limestone are supplied to a raw material inlet port 108 placed on the left side of a melting furnace 101 and are then melted at 1,600° C. to form base glass. The base glass is allowed to move in the melting furnace 101 in the right direction in the figure while the base glass releases bubbles contained therein.

The base glass moved from the melting furnace 101 is sent to a float bath 102 containing molten tin 104 having a surface that is flat due to gravity. The base glass is formed into a float glass plate 106 having a predetermined thickness in the float bath 102. A surface of the float glass plate 106 is in contact with the molten tin 104 in this step. This surface is called a bottom surface (tin-side surface) and the back of this surface is called a top surface (non tin-side surface). The float glass plate 106 contains tin at the periphery of the bottom surface.

The float glass plate 106 moved from the float bath 102 is sent to an annealing furnace 103 and is then annealed therein in order to remove permanent strain from the float glass plate 106 while the float glass plate 106 moves on rollers 105. After the float glass plate 106 is moved from the annealing furnace 103, the float glass plate 106 is cut into float glass substrates having a predetermined size at a cutting portion 107.

In each float glass substrate manufactured by this float process, large bubbles are removed from the base glass in the melting furnace 101. However, small bubbles having a diameter of about several hundred μm or less remain at the periphery of the top surface of the base glass, which is then solidified. Thus, the float glass substrate has small bubbles at the periphery of the top surface.

In conventional methods for manufacturing barrier ribs, the bubbles remaining in the float glass substrate do not cause problems because address electrodes, a dielectric layer, and the barrier ribs are formed on the float glass substrate.

However, in a method for directly forming barrier ribs in the float glass substrate by a subtractive process, the small bubbles remaining at the periphery of the top surface (non tin-side surface) of the float glass substrate cause the following defects in the barrier ribs when grooves are formed in the top surface: the grooves have a depth larger than a desired value in proportion to the size and number of the bubbles when the bubbles lie at the groove bottom, and the barrier ribs have holes extending therethrough when the bubbles lie in regions for forming the barrier ribs.

In order to solve the above problems, the inventors have researched defects in barrier ribs formed in the top surface of float glass substrates in detail, and found that such defects are caused by bubbles remaining at the periphery of the top surface of each float glass substrate. As a result, the inventors have made this invention in which grooves are formed in the bottom surface (tin-side surface) of the float glass substrate by a subtractive process to form barrier ribs for flat panel displays.

SUMMARY OF THE INVENTION

The present invention provides a method of manufacturing a substrate for a flat panel display, wherein the method includes forming a plurality of grooves in the bottom surface of a float glass substrate by a subtractive process to form barrier ribs comprising the protrusions remaining between the respective grooves.

In the above method, the subtractive process is a sandblast process.

In the above method, the subtractive process is a chemical etching process using an acid etchant.

In the above method, at least the bottoms of the grooves formed in the bottom surface of the float glass substrate are further smoothed to form electrode formation surfaces.

In the above method, the bottoms of the grooves are smoothed by partially melting the surfaces of the grooves by laser irradiation.

In the above method, the bottoms of the grooves are smoothed by sandblasting with an abrasive having a particle diameter for decreasing surface irregularities of the grooves and/or an abrasive composed of a material cut off from the substrate by forming the grooves.

In the above method, the bottoms of the grooves are smoothed by polishing the inside surfaces of the grooves with a dicing saw.

In the above method, the bottoms of the grooves are smoothed by coating a silicon-containing organic compound solution on the inside surfaces of the grooves, and then heating the coatings to form silicon dioxide films.

In the above method, electrodes are formed on the bottom surface smoothed by using a photolithographic process.

The present invention further provides a method of manufacturing a substrate for a flat panel display, wherein the method comprising forming a plurality of grooves in the bottom surface of a float glass substrate by a subtractive process to form barrier ribs comprising protrusions remaining between the respective grooves, and then forming electrodes on the bottoms of the grooves by an ink-jet process or dispensing process.

In the above method, the substrate is fired at a firing temperature being 40° C. higher than the softing point of the low-melting glass being contained in the electrodes.

BRIEF DESCRIPTION OF THE DRAWINGS

FIG. 8 is a illustration showing irregularities of grooves formed by a method for forming the barrier ribs according to the third embodiment of the present invention;

DESCRIPTION OF THE PREFERRED EMBODIMENTS

Figure 1A:
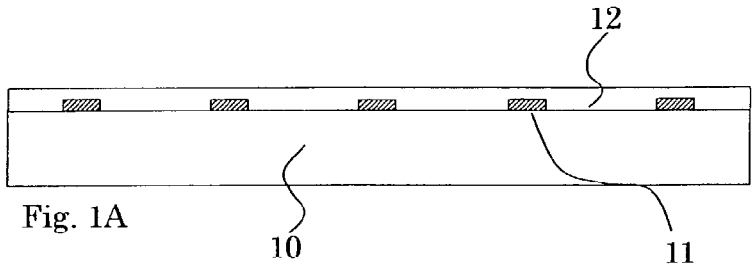
FIGS. 1A through 1E are a schematic illustration showing a conventional method for forming the barrier ribs.
Figure 1B:
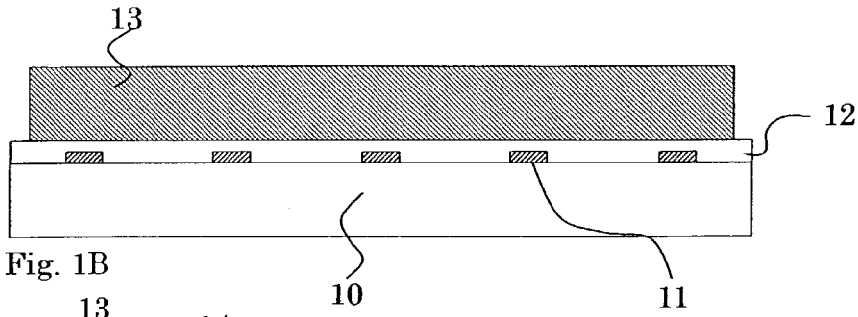
Figure 1C:
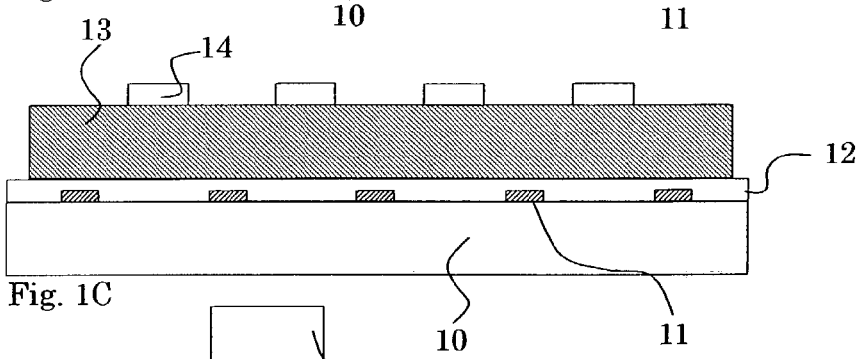
Figure 1D:
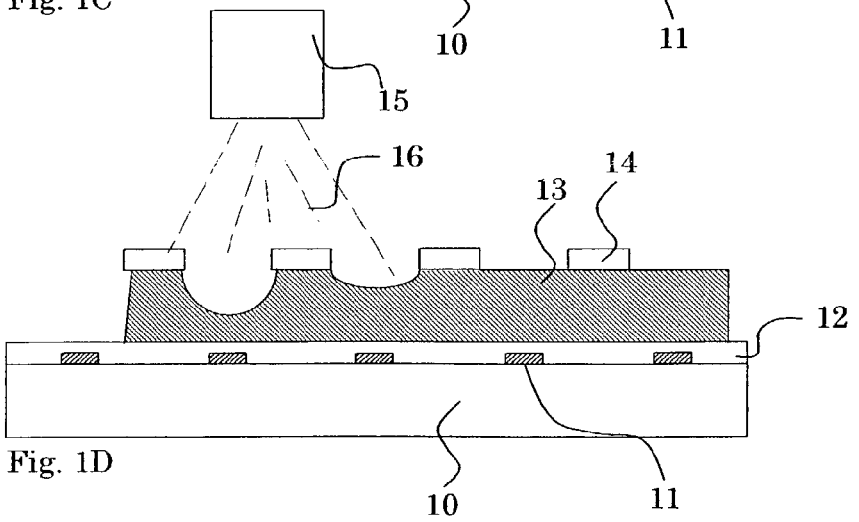
Figure 1E:
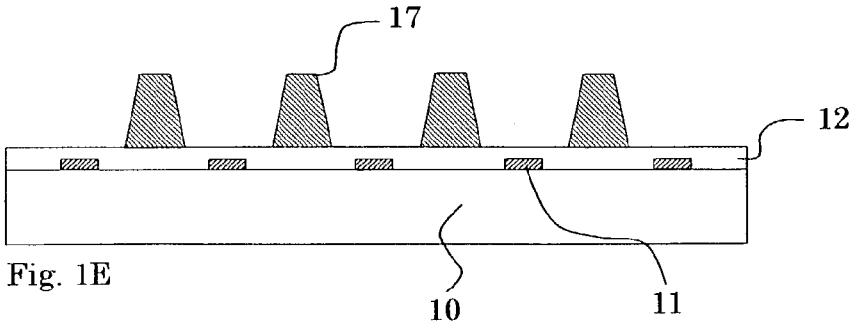
Figure 2:
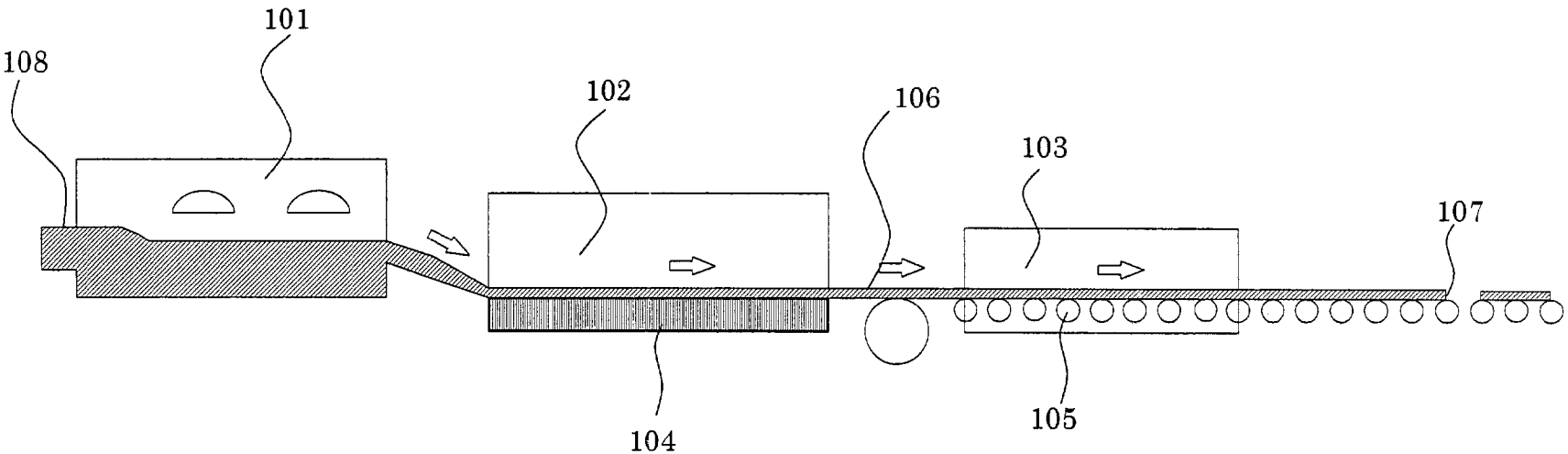
FIG. 2 is a schematic illustration showing a method for manufacturing a float glass substrate by a float process.
Figure 3:
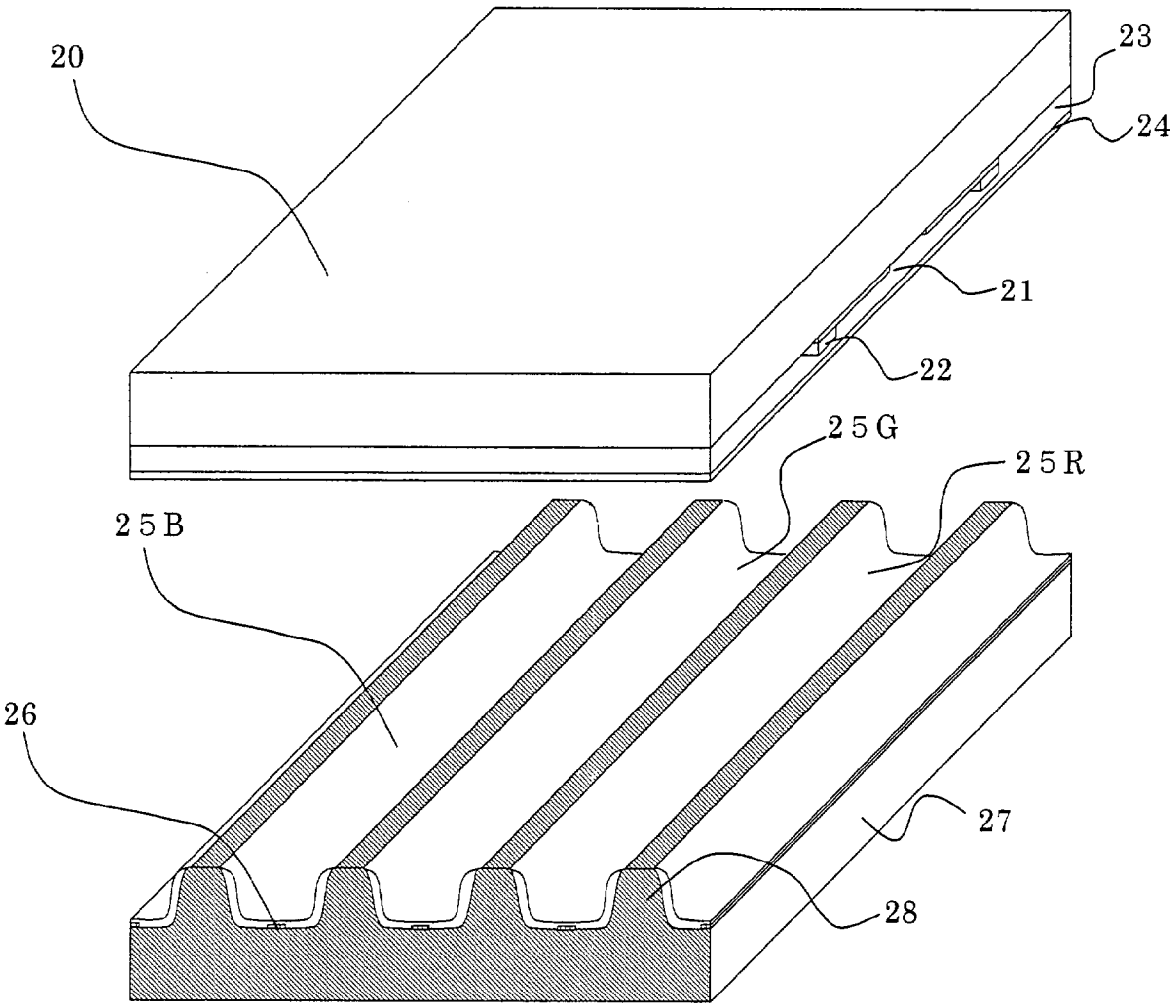
FIG. 3 shows a schmetically perspective view showing a plasma display panel including a rear float glass substrate having barrier ribs formed by a method of the present invention.

FIG. 3 is a perspective view showing a plasma display panel (PDP) including a rear float glass substrate 27 manufactured by a method for forming barrier ribs according to the present invention. The PDP further includes a front glass substrate 20. The front glass substrate 20 includes sustaining electrodes 21 comprising a transparent material such as ITO; bus electrodes 22 for reducing the resistance of electrodes; a transparent dielectric layer 23 comprising low melting glass; and a protective layer 24, formed by a deposition process, comprising MgO. These components are disposed on the lower surface of the PDP in that order. The transparent dielectric layer 23 covers the sustaining electrodes 21 and the bus electrodes 22.

The rear float glass substrate 27 includes barrier ribs 28, formed by a subtractive process, lying on the upper surface thereof; address electrodes 26; red fluorescent layers 25R; green fluorescent layers 25G; and blue fluorescent layers 25B. The address electrodes 26 are each disposed at the corresponding bottoms of grooves disposed between the corresponding barrier ribs 28. Each red fluorescent layer 25R, green fluorescent layer 25G, and blue fluorescent layer 25B are separately superposed on the corresponding address electrodes 26. Dielectric layers, which are not shown, may be each disposed over the corresponding address electrodes 26 and the side surfaces of the corresponding barrier ribs 28.

The front glass substrate 20 is joined to the rear float glass substrate 27 in such a manner that all the above components are placed between the front glass substrate 20 and the rear float glass substrate 27. A sealant is provided at the periphery of the joined substrates to seal the space therebetween. Gas is then evacuated from the space, and the space is then filled with a mixture gas containing rare gases such as neon and xenon, which are discharge gases.

The rear float glass substrate 27, manufactured by a float method, may comprise soda lime glass or high-strain point glass such as PD-200 manufactured by Asahi Glass Co., Ltd., or PP-8 manufactured by Nippon Electric Glass Co., Ltd.

First Embodiment

A method for manufacturing barrier ribs according to a first embodiment will now be described with reference to FIGS. 4A through 4E.

Figure 4A:
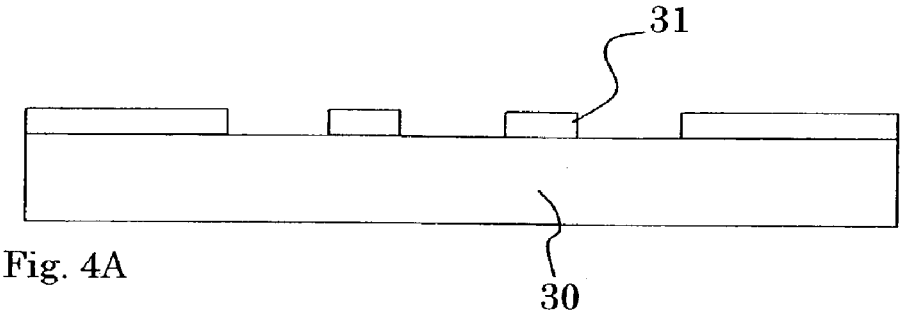
FIGS. 4A through 4E are a schematic illustration showing a method for forming barrier ribs according to a first embodiment of the present invention.

As shown in FIG. 4A, the dry resist film having sandblast resistance is joined to the bottom surface (tin-side surface) of a float glass substrate 30. The resulting dry resist film is developed by a photolithographic process to form resist pattern portions 31 such that the resist pattern portions 31 are disposed on corresponding regions for forming barrier ribs.

Figure 4B:
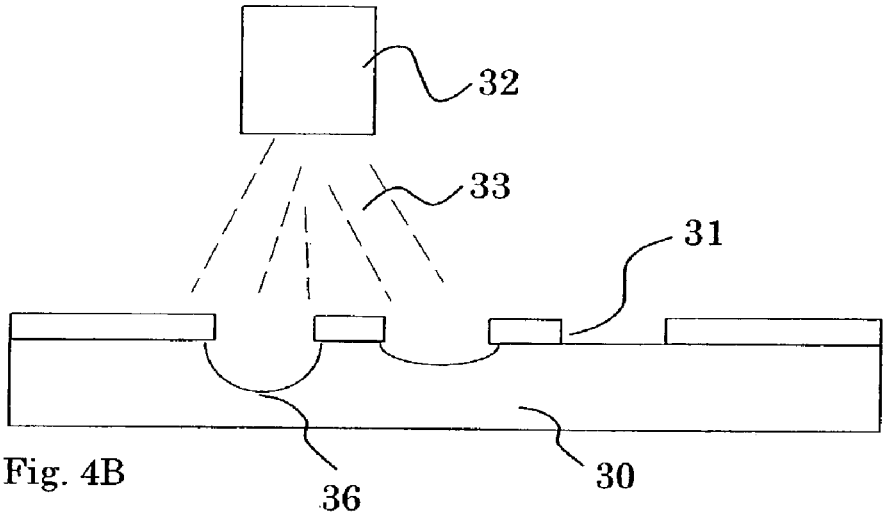

As shown in FIG. 4B, the bottom surface having the resist pattern portions 31 thereon is sandblasted with a sandblast gun 32 using an abrasive 33 comprising alumina or SiC particles having a diameter of about 10 to 20 μm to remove portions of the bottom surface, the portions not being covered with the corresponding resist pattern portions 31. Thereby, grooves 36 having a depth of about 150 to 200 μm are formed in the bottom surface.

Figure 4C:
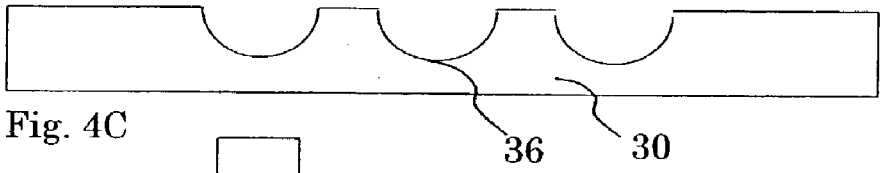
Figure 4D:
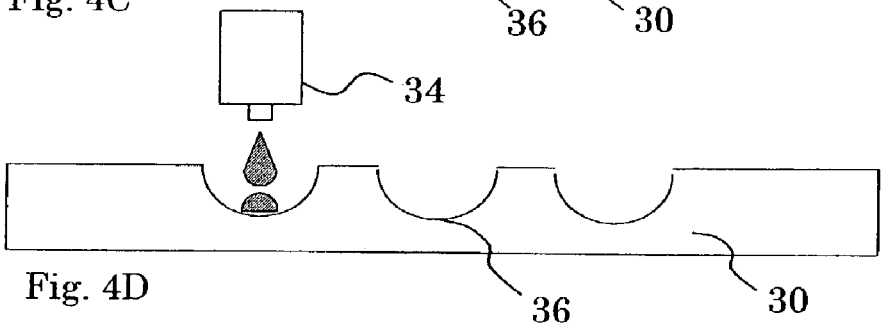

As shown in FIG. 4C, the resist pattern portions 31 are removed. As shown in FIG. 4D, an electrode material containing silver fine powders, low-melting glass fine powders, a resin, and an organic solvent is provided to the bottoms of the grooves 36 with an ink jet head 34 by an ink jet process. In this step, a dispensing process may be used instead of the ink jet process.

Figure 4E:
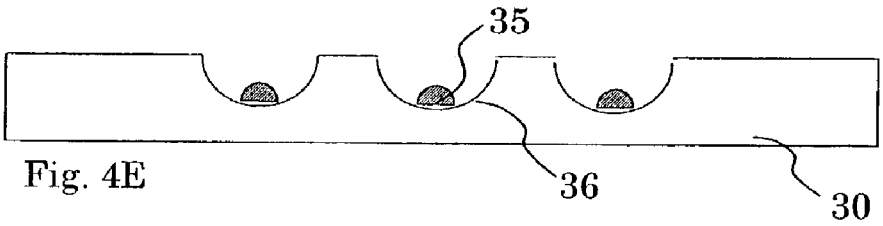

As shown in FIG. 4E, the electrode material disposed at the corresponding grooves 36 are fired at about 500 to 600° C. for about 15 minutes to form address electrodes 35. In this step, when the firing temperature is 40° C. higher than the softening point of the low-melting glass contained in the electrode material, the fine silver powders are sintered and then settled. Thus, the surface layers of the address electrodes 35 comprise only low-melting glass. Thereby, each surface layer functions as a dielectric layer. Alternatively, the following procedure may be employed: the electrode material is fired at a temperature near the softening point of the low-melting glass, low-melting glass paste is applied onto the grooves 36, and the low-melting glass paste is then fired to form the address electrodes 35 each having such a dielectric layer.

In this embodiment, the above sandblast process is used for forming the barrier ribs, as shown in FIG. 4B. However, a chemical etching process in which an acidic etchant is used may be employed instead of the sandblast process. In such a case, the resist pattern portions 31 shown in FIG. 4A must comprise an acid-resistant resist material.

Second Embodiment

In the first embodiment, the address electrodes 35 are formed by the ink jet process or the dispensing process, as shown in FIG. 4C. However, in such a method, there is the following problem: when a conductive layer is-formed on the processed substrate surface by a sputtering process after the step shown in FIG. 4C and the conductive layer is etched by a photolithographic process to form address electrodes, an etchant enters spaces, caused by irregularities on the groove surface, between the address electrodes and the groove surface to cause the over-etching of the conductive layer, thereby causing no reproducibility of the address electrodes.

Thus, when the address electrodes are formed by a photolithographic process, at least the groove surface for forming the address electrodes must be smoothed to remove such irregularities. Since the irregularities are due to the uneven composition of the float glass substrate 30, the irregularities are caused even if the grooves are formed by a sandblast or chemical etching process.

Figure 5A:
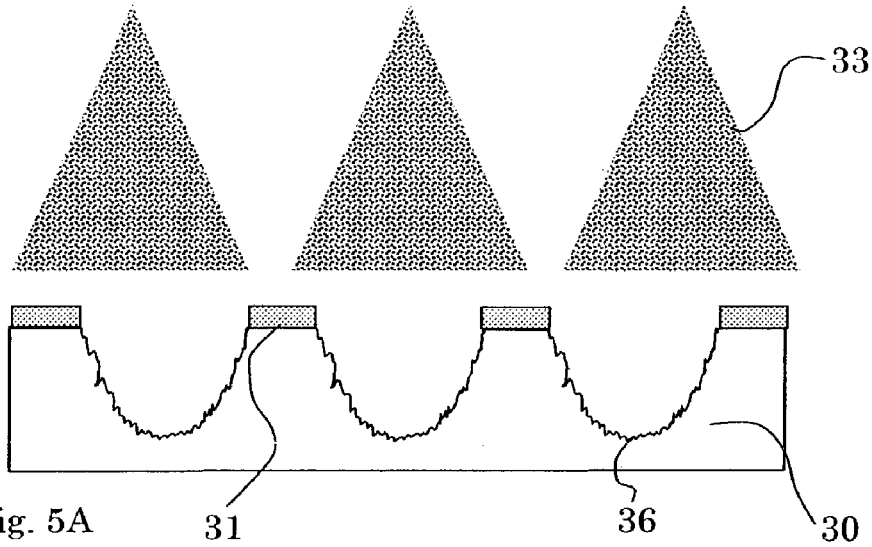
FIGS. 5A through 5C are a schematic illustration showing a method for forming barrier ribs according to a second embodiment of the present invention.
Figure 5B:
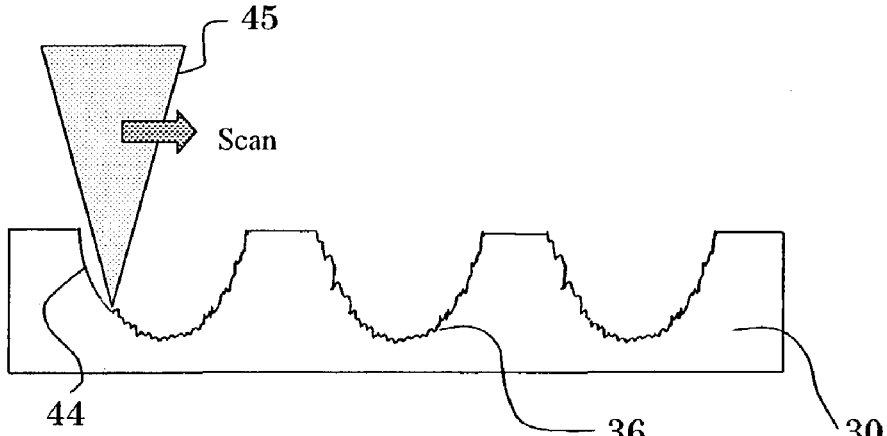
Figure 5C:
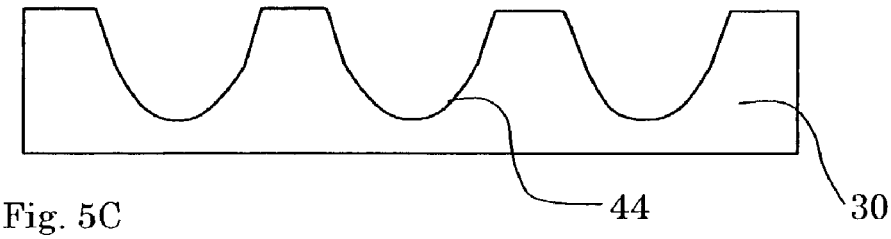

In order to solve the above problems, the following technique is provided in this embodiment. FIG. 5A is an illustration showing a manufacturing step corresponding to the step shown in FIG. 4B. As shown in FIG. 5A, grooves 36 are formed in a float glass substrate 30 and resist pattern portions 31 on the float glass substrate 30 are then removed. As shown in FIG. 5B, a $CO_2$ laser beam 45 having a wavelength of 10.6 μm and an intensity of 200 W/cm$^2$ is applied to the grooves 36 to partially melt the surfaces of the grooves 36 to remove the surface irregularities. Thereby, the grooves 36 are transformed into smooth grooves 44 having a smooth surface after the irradiation and the solidification, as shown in FIG. 5C. In this irradiation, the $CO_2$ laser beam 45 may be applied to the entire surfaces of the grooves 36 and may be alternatively applied only to the surface portions for forming the address electrodes.

Figure 6A:
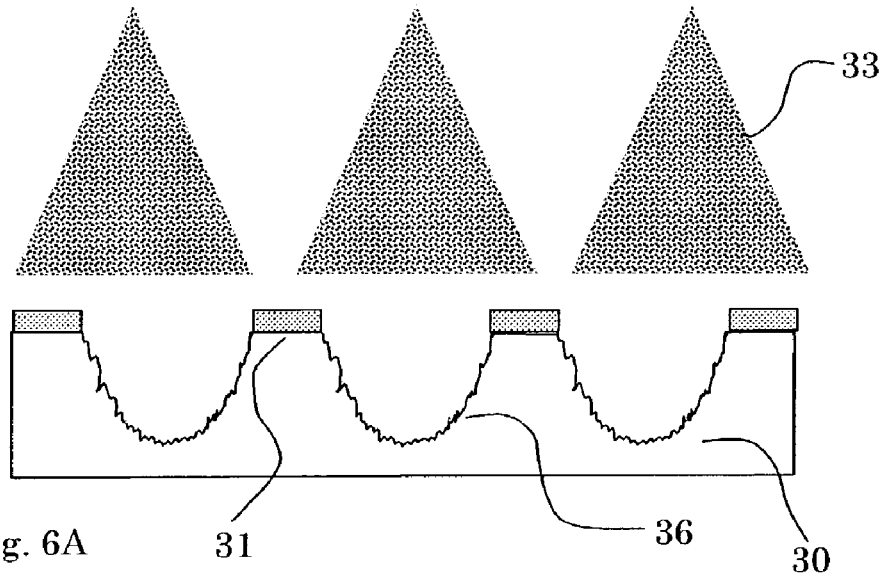
FIGS. 6A through 6C are a schematic illustration showing a method for forming barrier ribs according to a variation of the second embodiment of the present invention.
Figure 6B:
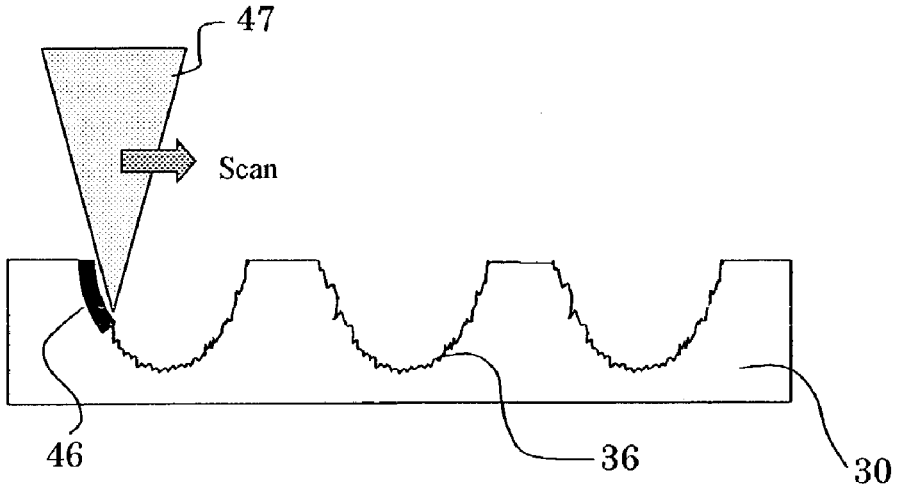
Figure 6C:
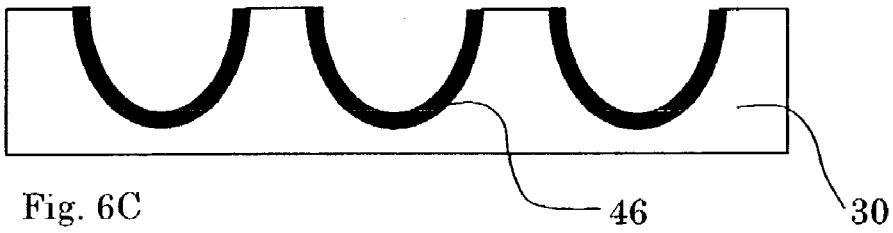

In the above procedure, the irradiation of the $CO_2$ laser beam 45 is performed in the atmosphere. As shown in FIGS. 6A through 6C, in a variation, the irradiation of an Ar excimer laser beam 47 having a wavelength of 126 nm may be performed at a pressure of several Torr in a mixture atmosphere of silane and carbon dioxide or nitrous oxide. When such irradiation is performed, the surfaces of the grooves 36 are partially melted, thereby transforming the irregular surfaces into smooth surfaces after the irradiation and the solidification. Furthermore, silane reacts with carbon dioxide or nitrous oxide at areas irradiated with the Ar excimer laser beam 47 to form a silicon oxide layer on the surface of each groove 36, thereby forming smooth layered grooves 46. In this irradiation, the Ar excimer laser beam 47 may be applied to the entire surfaces of the grooves 36 and may be alternatively applied to the surface portions for forming the address electrodes.

Third Embodiment

Figure 7:
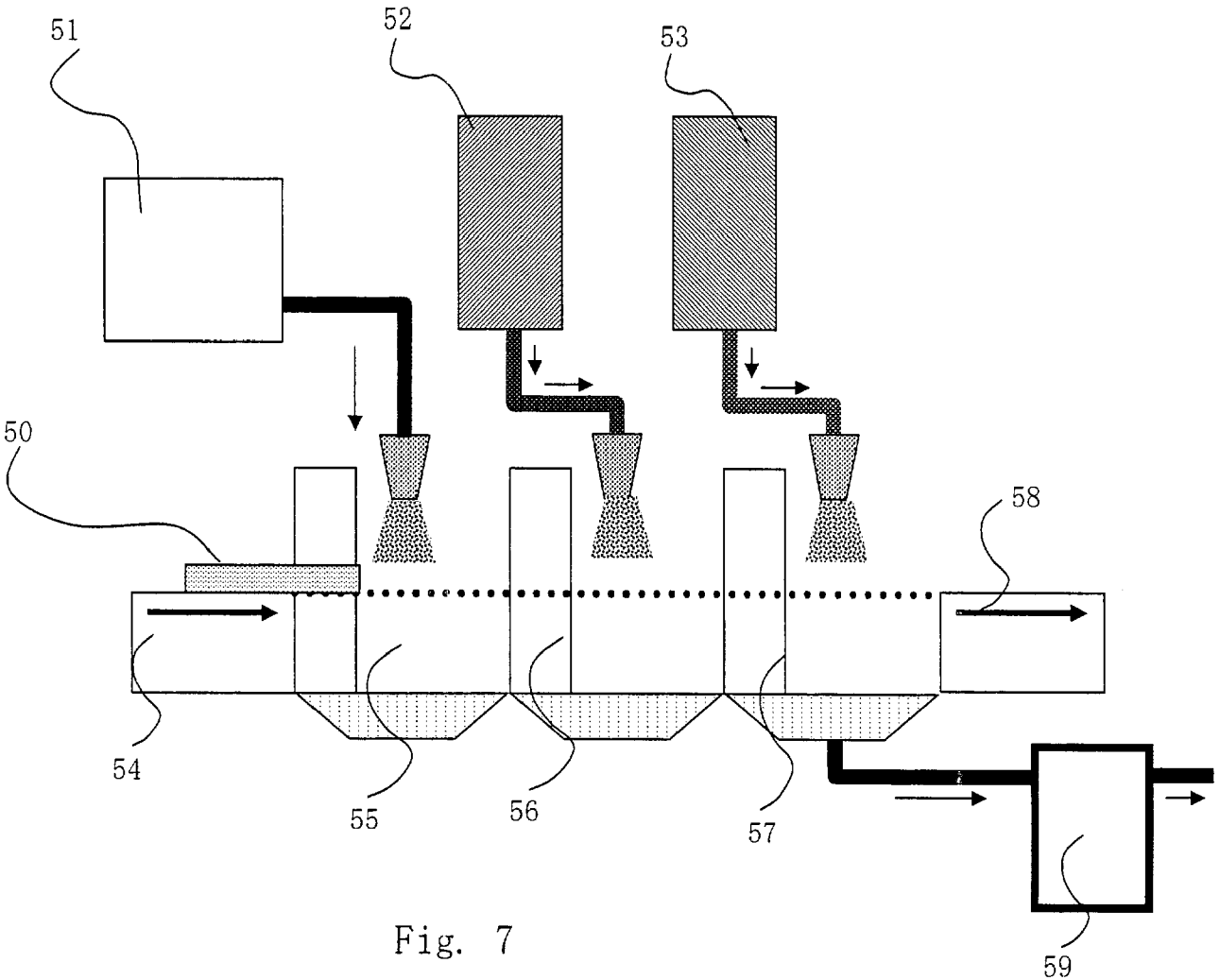
FIG. 7 is a schematic view showing an apparatus used for forming the barrier ribs according to a third' embodiment of the present invention.

FIG. 7 is a schematic view showing an apparatus used for forming barrier ribs according to a third embodiment of the present invention. This apparatus includes a plurality of sandblast units. A float glass substrate 50 is supplied to an inlet port 54, wherein the float glass substrate 50 has resist pattern portions that are formed in the same manner as that shown in FIG. 4A, have sandblast resistance, and lie on the bottom surface (tin-side surface). The float glass substrate 50 then enters a sandblasting chamber 55, in which the bottom surface is sandblasted using #600 alumina particles, supplied from a first abrasive tank 51, having an average diameter of 20 μm. Thereby, grooves having a predetermined depth are formed in the bottom surface. The particles supplied from the first abrasive tank 51 are not limited to particles comprising alumina and may comprise SiC.

The resulting float glass substrate 50 is then sent to a first smoothing chamber 56, in which the bottom surface is sandblasted using #1200 alumina particles, supplied from a second abrasive tank 52, having an average diameter of 10 μm. In this treatment, the depth of the grooves is not increased and irregularities on the groove surface are removed to smooth the groove surface. The particles supplied from the second abrasive tank 52 are not limited to particles comprising alumina and glass beads having substantially the same hardness as that of the float glass substrate 50 may be used instead. When the glass beads are used, the same effects as those obtained using the alumina particles can be obtained by controlling the degree of the crushing of the irregular portions and the glass beads. Chippings obtained by sandblasting the float glass substrate 50 may be used as an abrasive instead of the glass beads.

The resulting float glass substrate 50 is then sent to a second smoothing chamber 57, in which the bottom surface is sandblasted using #2000 alumina particles, supplied from a third abrasive tank 53, having an average diameter of 5 μm. In this treatment, since the #2000 alumina particles have a diameter smaller than that of the #1200 alumina particles used in the first smoothing chamber 56, the groove surface is further smoothed. The float glass substrate 50 processed in the second smoothing chamber 57 is then sent to an outlet port 58. Abrasive particles used in the sandblasting chamber 55, the first smoothing chamber 56, and the second smoothing chamber 57 are recovered with a dust collector 59. Glass chippings obtained by sandblasting the float glass substrate 50 are also recovered.

FIG. 8 is an illustration showing the treating conditions and the degree of the irregularity of the surfaces of grooves formed by a partition wall-forming method according to this embodiment. In the figure, Ry represents the maximum roughness defined as the absolute value of the maximum protrusion height above a reference level or the maximum recession depth below the reference level. Rz represents the average of the first to tenth-large absolute values of protrusion height above the reference level or recession depth below the reference level. Ra represents the average of the absolute values of protrusion heights above the reference level or recession depths below the reference level.

In FIG. 8, Sample 1 is a substrate processed only in the sandblasting chamber 55. Sample 2 is another substrate processed in the sandblasting chamber 55 and the first smoothing chamber 56. Sample 3 is another substrate processed in the sandblasting chamber 55 and the first smoothing chamber 56, wherein the blast pressure of the particles in the first smoothing chamber 56 is two times larger than that for Sample 2. Sample 4 is another substrate processed in the sandblasting chamber 55, the first smoothing chamber 56, and the second smoothing chamber 57.

The maximum roughness Ry is an index of irregularity causing problems in the manufacturing steps. Sample 1 has a maximum roughness Ry of 30.9 μm. Sample 2 has a maximum roughness Ry of 22.2 μm, that is, Sample 2 has a maximum roughness Ry smaller than that of Sample 1. Sample 3 has a maximum roughness Ry of 20.2 μm. Sample 4 has a maximum roughness Ry of 16.9 μm. That is, the maximum roughness Ry of Sample 4 is the minimum. Thus, the processing conditions of Sample 4 are preferable. It is preferable that the blast pressures of the particles in the first smoothing chamber 56 and the second smoothing chamber 57 are insufficient to form grooves. Ideally, in these smoothing steps, lower pressure and longer processing time are preferable. However, since the abrasive particles have a sufficiently small diameter, the blast pressures may be set such that the abrasive particles can be jetted in a stable manner.

When there are bubbles in regions for forming grooves in the top surface of a float glass substrate, formed grooves have a depth of several ten μm or more. Thus, even if the grooves are smoothed by the above method of this embodiment, the resulting grooves cannot have smoothness sufficient for practical use.

Fourth Embodiment

Figure 9A:
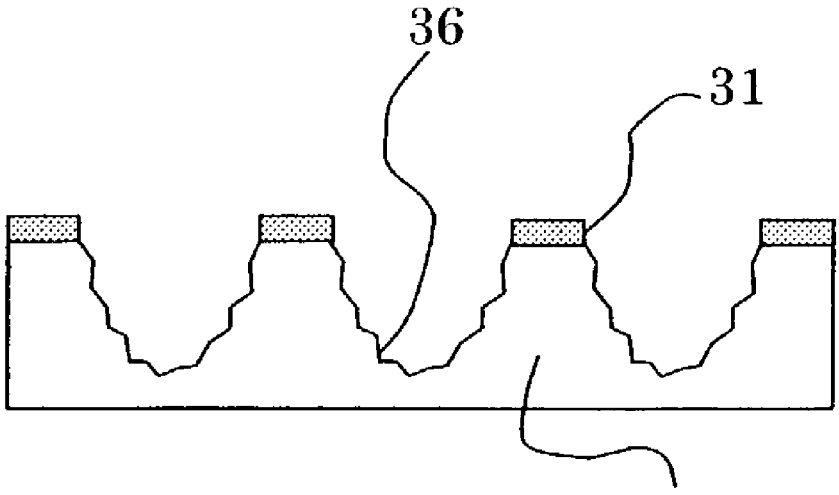
FIGS. 9A and 9B are a schematic illustration showing a method for forming barrier ribs according to the fourth embodiment of the present invention.
Figure 9B:
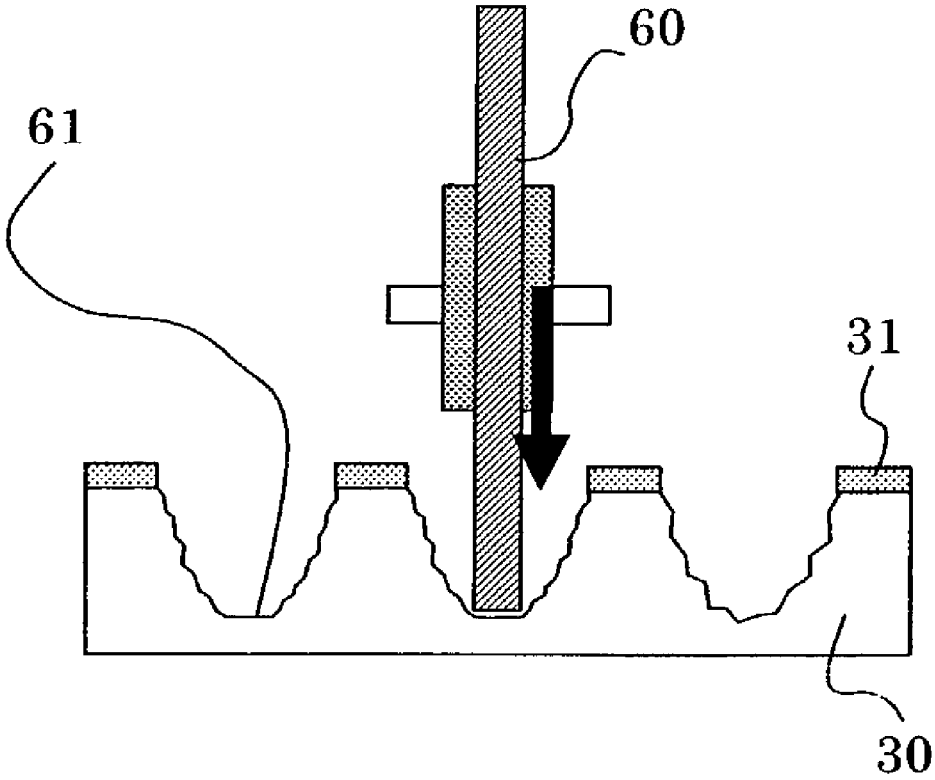

A method for manufacturing barrier ribs according to a fourth embodiment will now be described with reference to FIGS. 9A and 9B. FIG. 9A shows a float glass substrate 30 processed in the same manner as the step shown in FIG. 4B. As shown in FIG. 9B, the bottoms of grooves 36 formed by a subtract process are smoothed with a rotary dicing saw 60 having a width smaller than that of the grooves 36 to form smooth bottom portions 61. In this embodiment, the single dicing saw 60 is used. However, in another embodiment, a plurality of dicing saws arranged in parallel may be used, thereby achieving high throughput.

In general, when grooves having a depth of 150 to 200 μm are formed in float glass substrates only with such a dicing saw, edge of glass chippings tend to be formed depending on the durability of the dicing saw, thereby causing defects in the barrier ribs. However, in this embodiment, the dicing saw 60 is used only in the smoothing step to ground the float glass substrate 30 at a depth corresponding to the maximum roughness Ry at the maximum, wherein the depth is about several μm. Therefore, the durability of the dicing saw does not cause problems.

After the smooth bottom portions 61 are formed in all the corresponding grooves 36 with the dicing saw 60, resist pattern portions 31 are removed from the float glass substrate 30, which is cleaned up in this step.

In order to form the smooth bottom portions 61, a file having a width smaller than that of the grooves 36 may be used instead of the dicing saw 60.

Regions, disposed at the periphery of the float glass substrate 30, for forming terminal for connecting address electrodes to a driving circuit may be smoothed with a grinder after the smoothing step using the dicing saw 60.

Fifth Embodiment

A method for manufacturing barrier ribs according to a fifth embodiment will now be described with reference to FIGS. 10A through 10C. In this embodiment, FIG. 10A shows a float glass substrate 30 processed in the same manner as the step shown in FIG. 4B.

Figure 10A:
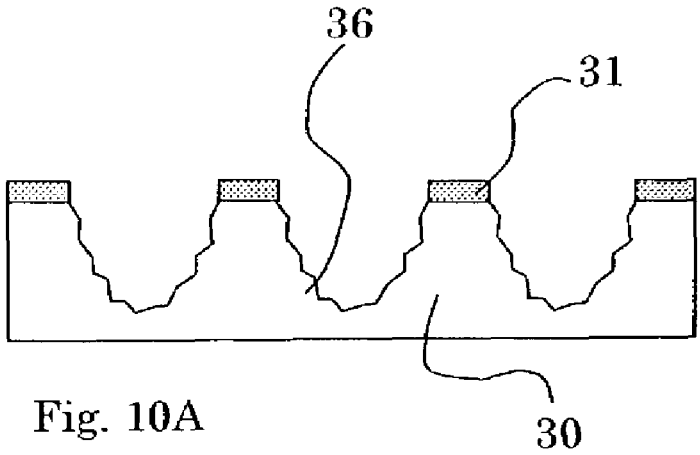
FIGS. 10A through 10C are a schematic illustration showing a method for forming barrier ribs according to the fifth embodiment of the present invention.
Figure 10B:
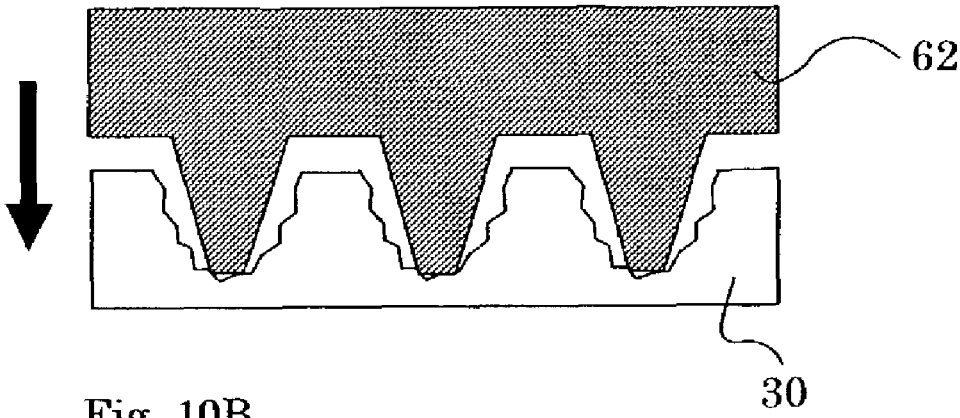
Figure 10C:
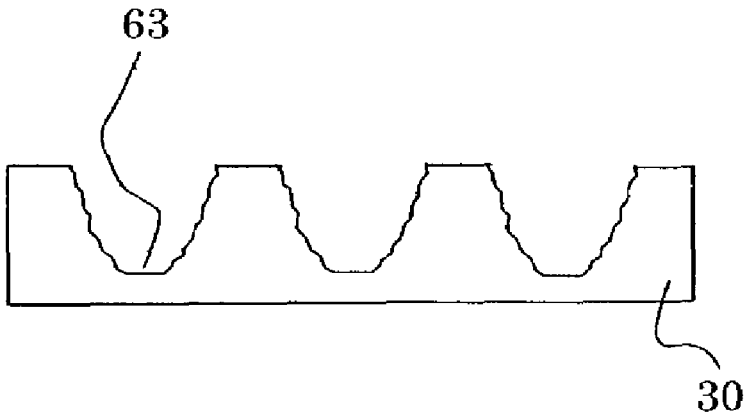

As shown in FIG. 10A, the float glass substrate 30 has resist pattern portions 31 thereon and grooves 36 therein. As shown in FIG. 10B, the resist pattern portions 31 are removed from the float glass substrate 30. A molding die 62 having a shape that is inverse to that of the grooves 36 is pressed against the float glass substrate 30. Only the molding die 62 or both molding die 62 and the float glass substrate 30 are heated up to the plastic deformation temperature of the float glass substrate 30. Thereby, flat bottom portions 63 are formed at the bottoms of the corresponding grooves 36 in the float glass substrate 30. The plastic deformation temperature depends on the linear load based on the contact area of the molding die 62 and the float glass substrate 30 and depends on the plasticity of the float glass substrate 30. The temperature is usually within a range of 300 to 600° C.

Sixth Embodiment

Figure 11A:
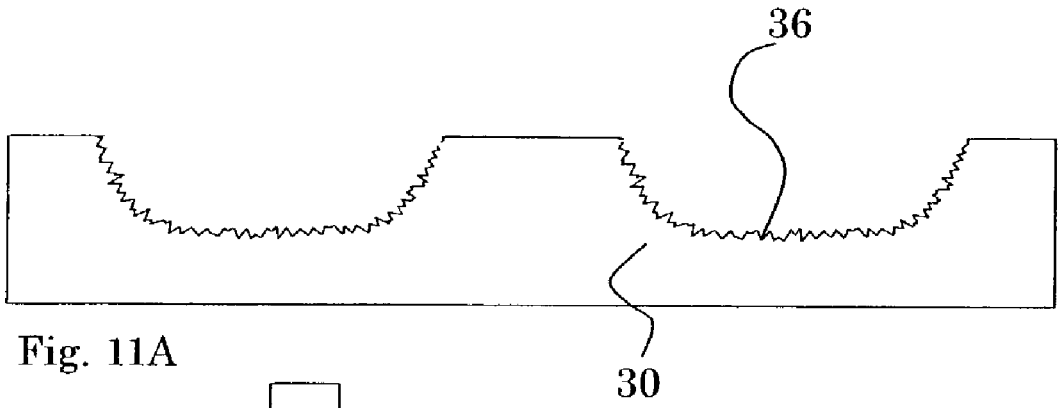
FIGS. 11A through 11C are a schematic illustration showing a method for forming barrier ribs according to the sixth embodiment of the present invention.

A method for planarizing a partition wall surface according to a sixth embodiment will now be described with reference to FIGS. 11A through 11C. FIG. 11A shows a float glass substrate 30 processed in the same manner as the step shown in FIG. 4B.

Figure 11B:
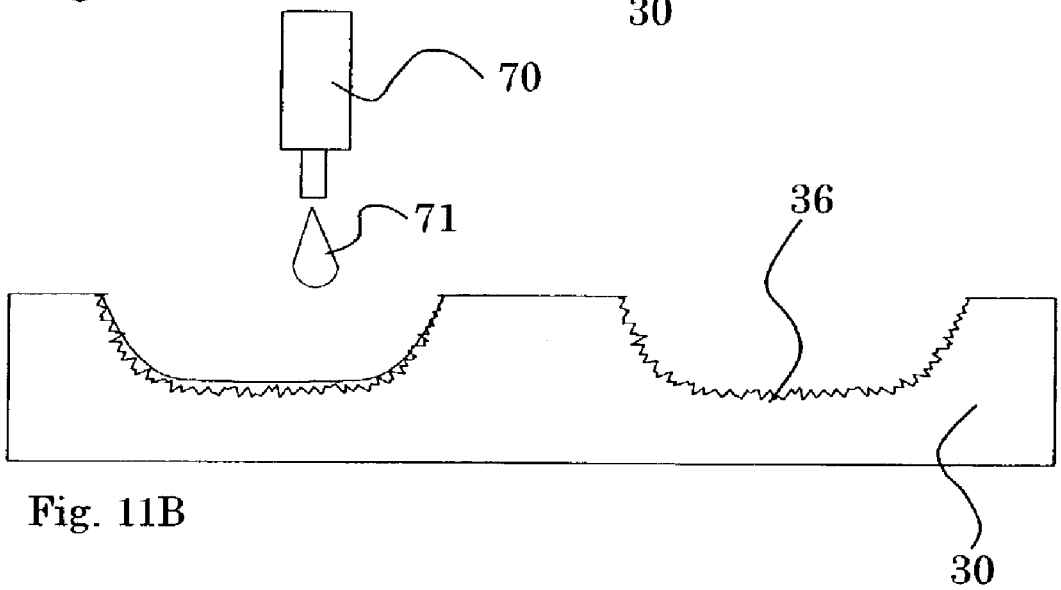
Figure 11C:
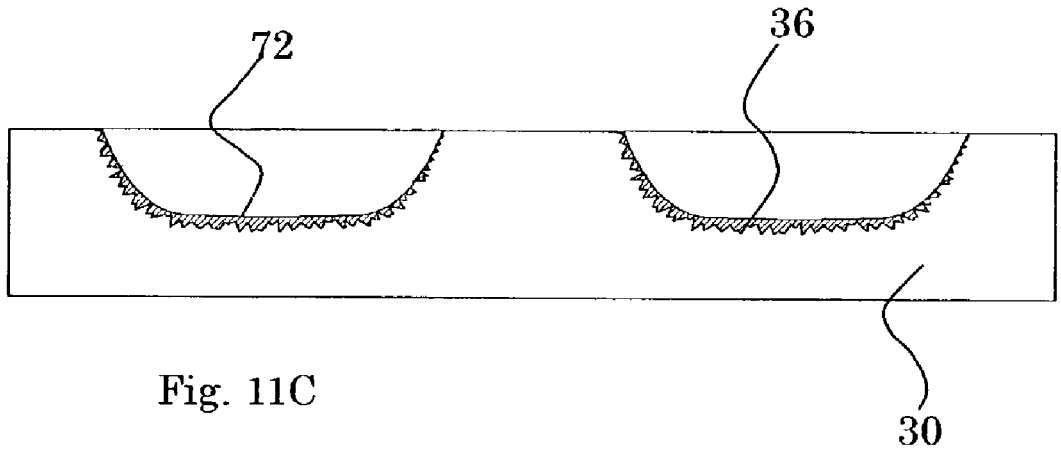

As shown in FIG. 11B, solution 71 is applied onto grooves 36 in the float glass substrate 30 with a dispenser 70. The solution 71 contains 5 g of ethyl alcohol and 10 g of an aliphatic acid silicon salt, such as silicon caproate, dissolved in the ethyl alcohol. A tool for the application of the solution 71 to the grooves 36 is not limited to such a dispensing process, and various processes may be used for the application as long as the solution 71 can be applied onto the grooves 36 in the float glass substrate 30. In this embodiment, the solution 71 contains silicon caproate. However, the solution 71 may contain another aliphatic acid silicon salt, for example, tetraethoxysilane (TEOS). In this case, the mixing ratio of the aliphatic acid silicon salt and alcohol must be changed as compared with the above. After the application, the resulting float glass substrate 30 is dried at 60° C. for 10 minutes in a drying furnace.

After the drying step, the resulting float glass substrate 30 is then fired at 400° C. for one hour to form silicon oxide layers 72 on the grooves 36 having irregular surfaces. Thereby, the irregular surfaces are covered with the corresponding silicon oxide layers 72, as shown in FIG. 9C. The silicon oxide layers 72 have an expansion coefficient smaller than that of the float glass substrate 30. Thus, when flat panel displays including such a float glass substrate are turned on and the temperature of the float glass substrate is increased, a compressive stress is applied to grooves in the float glass substrate. Thereby, the formation of cracks in the float glass substrate can be prevented. Such cracks tend to arise from microcracks due to irregularities of the grooves.

EXAMPLE 1

Ten 42-inch panel substrates having grooves on the top surface (non tin-side surface) and additional ten 42-inch panel substrates having grooves on the bottom surface (tin-side surface) were prepared, wherein these substrates have the configuration shown in FIG. 4C. These substrates were visually inspected to measure the number of defects in the barrier ribs and in the grooves. As a result, in the substrates having the grooves on the top surface, the average defect number was 5.5. In contrast, in the substrates having the grooves on the bottom surface, the defect number was zero.

As described above, according to the present invention, a method for manufacturing a substrate for flat panel displays is provided, thereby manufacturing such a substrate having high reliability at low cost.

What is claimed is:

1. A method of manufacturing a substrate for a flat panel display, the method comprising:

selecting a bottom surface, which is a side having an imprint of contact with molten tin, of a float glass substrate; and forming a plurality of grooves in the selected surface of the float glass substrate by a subtractive process forming barrier ribs, the barrier ribs comprising protrusions remaining between the respective grooves.

2. A method of manufacturing a substrate for a flat panel display according to claim 1, wherein the subtractive process is a sandblast process.

3. A method of manufacturing a substrate for a flat panel display according to claim 1, wherein the subtractive process is a chemical etching process using an acid etchant.

4. A method of manufacturing a substrate for a flat panel display according to claims 1, further comprising smoothing bottoms of the grooves formed in the selected surface of the float glass substrate, the smoothed bottoms of the grooves formed electrode formation surfaces.

5. A method of manufacturing a substrate for a flat panel display according to claim 4, wherein the smoothing the bottoms of the grooves comprises partially melting the surfaces of the grooves by laser irradiation.

6. A method of manufacturing a substrate for a flat panel display according to claim 4, wherein the smoothing the bottoms of the grooves comprises sandblasting with an abrasive having a particle diameter decreasing surface irregularities of the grooves, or an abrasive composed of a material cut off from the substrate by forming the grooves, or both.

7. A method of manufacturing a substrate for a flat panel display according to claim 4, wherein the bottoms of the grooves comprises polishing the inside surfaces of the grooves with a dicing saw.

8. A method of manufacturing a substrate for a flat panel display according to claim 4, wherein the bottoms of the grooves comprises:

coating a silicon-containing organic compound solution on the inside surfaces of the grooves, and heating the coatings forming silicon dioxide films.

9. A method of manufacturing a substrate for a flat panel display according to claim 4, further comprising forming electrodes on the smoothed bottom surface by using a photolithographic process.

10. A method of manufacturing a substrate for a flat panel display, the method comprising:

forming a plurality of grooves in the bottom surface of a float glass substrate by a subtractive process to forming barrier ribs comprising protrusions remaining between the respective grooves, and forming electrodes on the bottoms of the grooves by an ink-jet process or dispensing process.

11. A method of manufacturing a substrate for a flat panel display according to claim 10, further comprising firing the substrate at a firing temperature 40° C. higher than a softening point of the low-melting glass in a material forming the electrodes.

12. A method of manufacturing a substrate for a flat panel display, the method comprising forming a plurality of grooves directly on a bottom surface of a float glass substrate, wherein protrusions remaining between respective grooves form barrier ribs.

13. The method of manufacturing a substrate for a flat panel display, according to claim 12, wherein electrodes formed in the grooves are not in contact with the bottom surface.

* * * * *

UNITED STATES PATENT AND TRADEMARK OFFICE

CERTIFICATE OF CORRECTION

PATENT NO. : 7,473,151 B2
APPLICATION NO. : 10/438199
DATED : January 6, 2009
INVENTOR(S) : Osamu Toyoda et al.

It is certified that error appears in the above-identified patent and that said Letters Patent is hereby corrected as shown below:

Column 10, Line 8, change “claims” to --claim--.

Column 10, Line 11, change “formed” to --forming--.

Column 10, Line 14, after “melting” delete “the”.

Column 10, Line 23, after “wherein” insert --the smoothing--.

Column 10, Line 27, after “wherein” insert --the smoothing--.

Column 10, Line 38, before “bottom” change “the” to --a--.

Column 10, Line 39, after “process” delete “to”.

Column 10, Line 41, change “grooves,” to --grooves;--.

Column 10, Line 42, before “bottoms” delete “the”.

Column 10, Line 47, after “point of” delete “the”.

Signed and Sealed this

Thirty-first Day of March, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,473,151 B2
APPLICATION NO. : 10/438199
DATED : January 6, 2009
INVENTOR(S) : Osamu Toyoda et al.

It is certified that error appears in the above-identified patent and that said Letters Patent is hereby corrected as shown below:

First Page, Column (73) Assignee: delete "Hitachi, Ltd." and insert to
--HITACHI PLASMA PATENT LICENSING CO., LTD.--.

Signed and Sealed this

Second Day of November, 2010

David J. Kappos

David J. Kappos
*Director of the United States Patent and Trademark Office*